United States Patent [19]

Meissner

[11] Patent Number: 4,817,381

[45] Date of Patent: Apr. 4, 1989

[54] PROCESS AND APPARATUS FOR REGISTERING DEAD SPINNING OR TWISTING STATIONS

[75] Inventor: Werner Meissner, Hattenhofen, Fed. Rep. of Germany

[73] Assignee: Zinser Textilmaschinen GmbH, Ebersbach/Fils, Fed. Rep. of Germany

[21] Appl. No.: 131,877

[22] Filed: Dec. 11, 1987

[30] Foreign Application Priority Data

Dec. 18, 1986 [DE] Fed. Rep. of Germany ..... 3643300

[51] Int. Cl.[4] ..... D01H 13/32; D01H 15/00

[52] U.S. Cl. ..... 57/265; 57/261; 57/264; 364/470

[58] Field of Search ..... 57/261–265, 57/1 R; 364/470

[56] References Cited

FOREIGN PATENT DOCUMENTS 2454721 5/1976 Fed. Rep. of Germany .
2502426 7/1976 Fed. Rep. of Germany .
2635714 2/1978 Fed. Rep. of Germany .

*Primary Examiner*—John Petrakes
*Attorney, Agent, or Firm*—Herbert Dubno; Ronald Lianides

[57] ABSTRACT

A process and apparatus for registering dead workstations of a spinning or twisting machine in a memory is described. For each workstation whether or not it is registered as dead or not is tested. Then, each time a yarn starting carriage arrives at it, whether or not a yarn break is present at it is also tested. In case the workstation involved is registered as dead that registration as "dead" is then erased when no yarn break is present at that workstation.

16 Claims, 3 Drawing Sheets

PROCESS AND APPARATUS FOR REGISTERING DEAD SPINNING OR TWISTING STATIONS

FIELD OF THE INVENTION

My present invention relates to a process and apparatus for registering inactive or negative dead work stations in a spinning or twisting machine

BACKGROUND OF THE INVENTION

Dead, inactive or negative workstations of a spinning or twisting machine, advantageously a ring spinning machine, in which yarn breaks can be automatically eliminated by a yarn-starting carriage, can also be registered automatically.

Any workstation at which, after a yarn break, a predetermined number of successive yarn break elimination attempts by the yarn-starting carriage have failed, is automatically registered in a memory as a dead workstation and the yarn-starting carriage at each of the workstations which is registered as dead performs no yarn break elimination attempts.

By "workstation" I mean a spinning station or a twisting station of the spinning and/or twisting machine involved. Yarn is made by spinning and/or twisting at each workstation.

The spinning machine can be advantageously a ring spinning machine or, if necessary, another spinning machine such as a bell spinning machine, a top spinning machine or the like. The twisting machine can advantageously be a matter of a ring twisting machine but, can be also another type of twisting machine.

In one known process of this kind (German Pat. No. 24 54 721), every workstation at which a predetermined number of successive yarn break elimination attempts by the yarn-starting carriage during its idle time fail, that workstation is registered as dead (therein called "negative" workstations) and all registered dead workstations are passed by the yarn-starting carriage without a yarn-starting attempt.

The registering of the dead workstations can be undertaken in a central memory. On running of the yarn-starting carriage along the spinning or twisting machine, before arrival of the yarn-starting carriage at the next workstation, the memory is read to determine whether this next workstation is registered as "dead," i.e. that means registered as a dead workstation and, when this is the case, the yarn-starting carriage is caused to pass by it without halting.

A dead workstation then usually is present when because of some reason a yarn break cannot be fundamentally eliminated and/or because of missing roving, or yarn tangle on a set of drafting rolls and, in ring spinning or ring twisting machines, operation breaks.

When the problem at one of these workstations registered as dead is eliminated and thus yarn can be spun or twisted again at it, the registry of this workstation as "dead" in the memory must be erased. It is conceivable that for this purpose at each workstation a switch operable by an operator manually for erasing its registration as "dead" is located. That is, however, a very expensive construction.

Alternatively the operator goes to a central control station which is located at the end of the machine or on the yarn-starting carriage and there erases the registration of that workstation as dead by inputting the number or other code of this workstation. In this case the number of the workstations can however be delivered incorrectly or erroneously.

OBJECTS OF THE INVENTION

It is an object of my invention to provide an improved process and apparatus for registering dead spinning and/or twisting stations which will obviate these drawbacks.

It is also an object of my invention to provide an improved process and apparatus for registering dead spinning or twisting stations in which erasure of the registration of the workstations registered as dead in the memory is made when appropriate in a simple and reliable error-free way.

SUMMARY OF THE INVENTION

These objects and others which will become more readily apparent hereinafter are attained in accordance with my invention in a process for registering a plurality of dead workstations of a spinning or twisting machine, advantageously a ring spinning machine, in which yarn breaks can normally be automatically eliminated by a yarn-starting carriage. Each of the workstations at which after one yarn break for whose elimination a predetermined number of successive yarn break elimination attempts by the yarn-starting carriage fail, that workstation is automatically registered in a memory as a dead workstation and the yarn-starting carriage at each of these workstations which is registered as dead performs no further yarn break elimination attempts.

Each of the workstations, whether or not the work station is registered as dead, is automatically tested in accordance with the invention each time the yarn-starting carriage reaches the workstation, and whether a yarn break is present or not, is automatically tested regardless of whether the workstation is registered as dead or not and, in case the workstation is registered as dead, the registration of the workstation as dead is automatically erased when a yarn break is not present at the workstation.

Alternatively, at each workstation when the yarn-starting carriage reaches the workstation it is automatically tested, and when a yarn break is present at that workstation, an erasing signal is automatically generated without analysis of the memory, and when the workstation inspite of the presence of yarn is registered as dead, causes or effects erasure of the registration of that workstation as being dead.

Automatic erasure of the registration of workstations registered as dead in the memory always occurs in both embodiments of my invention when the yarn-starting carriage finds no yarn break present at a workstation. Generally the yarn-break has been repaired by the operator in the intervening time manually.

In rare cases an erroneous registration of the work station as dead which then is automatically corrected again could have occurred. The operator who eliminates the situation which has led to the registration of the workstation as dead at that workstation need not attempt to erase this registration as dead in the memory and can thus not be involved in an erroneous erasure since he is not on the whole involved with the erasure process.

The yarn-starting carriage senses or tests continuously whether a yarn break is present or not on arrival at a workstation and if no yarn break is present, or if a yarn is present, and the workstation involved is registered as dead in the memory, then the spinning and/or twisting of yarn at this workstation is actuated so that it "lives" and its registration as "dead" in the memory is automatically erased.

The processes according to my invention are exceptionally simple and reliable and may be performed automatically with simple means. Thus it is not necessary to halt the yarn-starting carriage at each workstation, but the sensing or testing whether a yarn break is present or not can occur appropriately during the yarn-starting carriage travel, advantageously at full speed.

Advantageously the testing as to whether a yarn break is present or not occurs without contact; for example it can be performed appropriately photoelectrically in an extremely short time. Simultaneously also the memory can be read in an extremely short time to determine whether the workstation involved is registered as dead or not.

In case no yarn break is present but the workstation involved is registered as dead, the uninterrupted further running of the yarn-starting carriage can be immediately commanded and/or a command for stopping the yarn-starting carriage can be omitted and the immediate erasure of the dead registration in the memory can be commanded and performed. Without that the running of the yarn-starting carriage must be slowed down. The yarn-starting carriage thus need only to stop at the workstation at which a yarn break is to be eliminated, also at workstations at which yarn breaks are present and which are not registered as dead.

The memory can have a suitable structure, advantageously a data logger as is standard in data processing, for example a core memory, a magnetic tape storage device or the like. The complete data processing unit serving for registration, reading and erasure of the location of the dead workstations can operate electronically.

I can provide, as described in German Pat. No. 24 54 721, that every workstation at which a predetermined number of yarn breaks occur in a predetermined time interval be registered as dead in the memory; the erasure of this registration occurs as I have described it.

Also other criterion can be given to register the workstation as dead and the erasure of each workstation registration as dead in the memory can be effected according to the process of my invention.

The memory can be located at any of a number of suitable positions in the spinning or twisting machine or on the yarn-starting carriage or at other arbitrary positions. It can be suitably structured for example so that it has memory locations acting to store the number of the workstation which is dead for each workstation to which the addressable store signal, the addressable read signal and the addressable erasure signal are conducted. The store signal acts to input the data into the memory to register the workstations concerned as dead in the memory. The read signal acts on arrival of the yarn-starting carriage at a workstation to read whether the workstation is registered as dead or not. The erasure signal serves to erase again the workstations registered as dead in the memory or to activate the erasure. Alternatively of course only the number of the dead workstation could be stored in a memory.

As described in German Pat. No. 24 54 721 a counter can be mounted on the yarn-starting carriage in a known way in another form which is stepped by "1" at each workstation of the spinning or twisting machine. It is reset to "1" at each complete circuit about the machine at a certain or predetermined spinning station. Since the contents of the counter are incremented by "1" at each workstation, its tally or contents correspond to the number of the workstation opposite which the yarn-starting carriage is located.

The incrementing of the counter can occur for example photooptically. Markings can be positioned at each workstation which are detected mechanically or without contact by a sensor located on the yarn-starting carriage and each such sensor advantageously steps up the electronic counter by a counting increment.

It can happen under certain circumstances that the counter is out of step with the location of the yarn-starting carriage when the yarn-starting carriage is pushed by an operator with the counter switched off for one or more workstations and then again the counter is switched on.

On further running of the yarn-starting carriage the number of the workstation no longer agrees with the contents of the counter and further erroneous erasure of workstations registered as dead can occur or registration of dead workstations under an erroneous address can occur.

This counter falls in step however at the beginning of the next circuit of the yarn-starting carriage at the first spinning station since it is again reset to "1" at that location independently of its contents.

Generally, comparatively few dead spinning stations are registered simultaneously, so that a falling out of step of the counter normally occurs only comparatively rarely.

At most at only a few dead workstations the yarn staring carriage does not run past but because of the counter located being out of step detects only the yarn break, not however the registration as dead, and so tries to eliminate the unremovable yarn break.

Then, when the predetermined number of yarn break removal attempts, for example two or three yarn break removal attempts, have been unsuccessfully made, this workstation is registered as dead in the memory under an erroneous number, also at its location another workstation is incorrectly registered as dead.

In the next circuit however the yarn-starting carriage eliminates that mistake when its counter is again in step, since workstations erroneously registered as dead in the memory in the preceeding circuit cycle are detected as not dead and the erroneous registration is automatically erased.

Eventually incorrectly erased dead workstations are again detected and registered as dead in the next circuit cycle of the yarn-starting carriage when its counter again is in step. Damage due to these errors cannot occur.

One can reduce the erroneous or incorrect registrations occurring due to the counter being out of step because one can make markings or code markings which contain the correct number of the workstation which are read by a sensor positioned on the yarn-starting carriage along the machine at predetermined workstations, for example at every 20 or 100 workstations.

At every arrival of the yarn-starting carriage at one of the workstations provided with such markings, what number that workstation has is signaled directly to the counter or to a comparator associated with the counter or else to adjusting means associated with the counter. In the comparator simultaneously the number of the workstation found in the counter is delivered and if that number differs from the actual number of that workstation(which is incorrect), the tally or counter contents are adjusted to the actual number of this workstation or the adjustment of the counter to the actual number of that workstation is continuously commanded whether or not the number in the counter is correct or not so that the counter is similarly adjusted when the number located in it is incorrect. In both cases the counter again is automatically brought into adjustment.

In many cases it is advantageous to reset the yarn-starting carriage to the starting point of its counting after a shift which its counter configuration does not follow and then to start again with a correct count.

The yarn-starting carriage can be associated with a single spinning or twisting machine. However it is possible that it is associated with a plurality of spinning or twisting machines. In this case one memory can be provided for the plurality of spinning or twisting machines or a memory can be provided for each spinning or twisting machine. Also the workstations in one spinning or twisting machine can be subdivided into a plurality of groups and each group can be associated with a single memory for registering the dead spinning stations of that group.

The relation of the workstations to the memory locations of the memory can occur in other ways also. For example in many cases it can be provided advantageously that at each workstation a marking or code markings, for example a bar code, can be provided which contains the data which identifies the particular workstation.

A sensor is located then on the yarn-starting carriage which senses the markings or code and its contents can be read to provide the number of the workstation. It can then be associated with a single memory location in the memory and the number or the like of that particular workstation is the address for the memory location associated with it and this address thus acts to conduct store signals, read signals and erase signals to that memory location. Or it can be provided that only the number or other data for the workstation which is registered as dead is delivered to the memory and this number or the like can then be supplied to the memory and on each query or reading of the memory whether a certain workstation is registered as dead can be stored in the memory so that it can be checked whether the number or the other data of this workstation is or is not stored in the memory. For erasing, the command which erases the number or the like can be fed to the memory.

BRIEF DESCRIPTION OF THE DRAWING

The above and other objects, features and advantages of my invention will become more readily apparent from the following description, reference being made to the accompanying highly diagrammatic drawing, in which.

SPECIFIC DESCRIPTION

Figure 1:
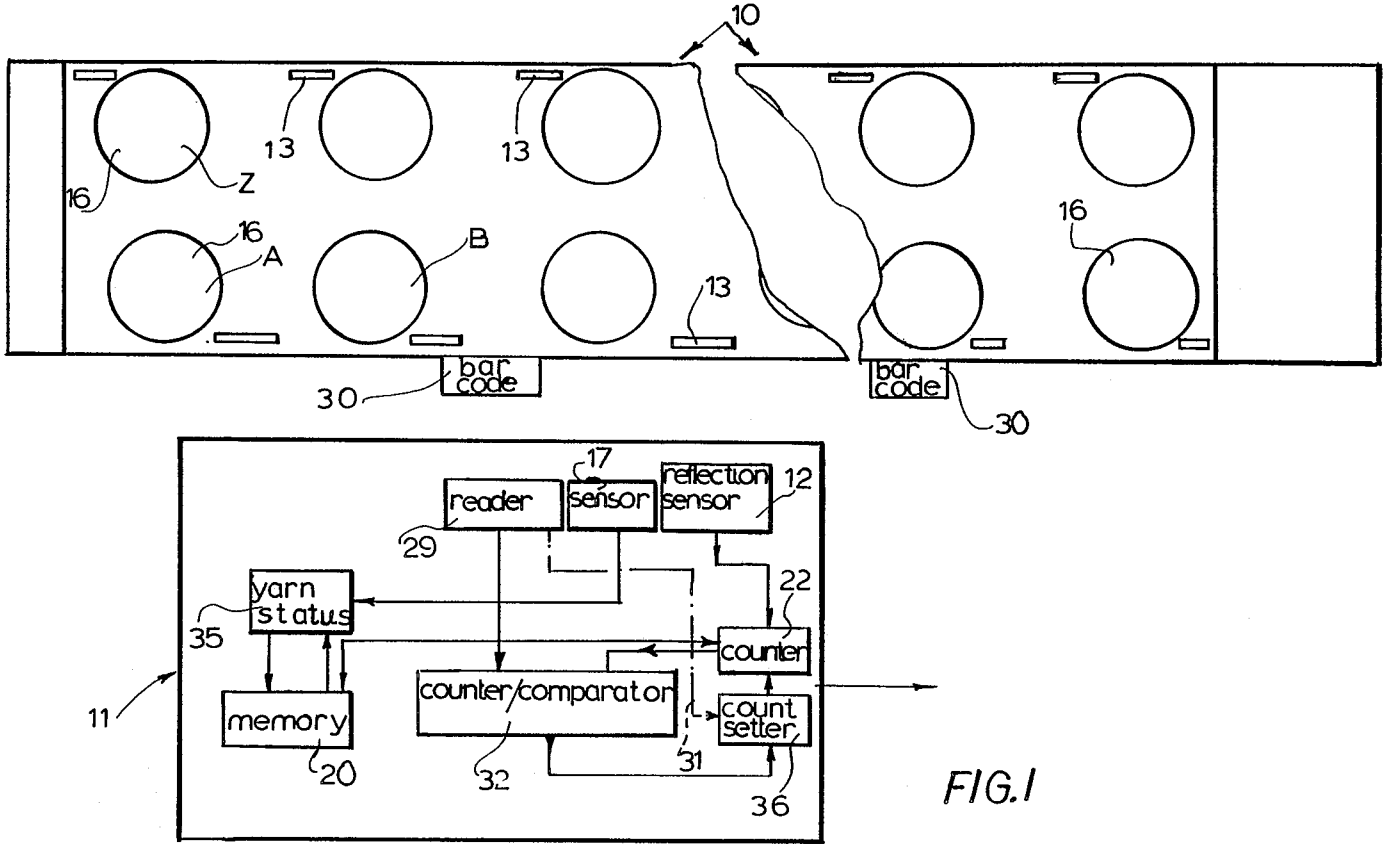
FIG. 1 is a schematic cutaway plan view of a spinning or twisting machine around which a yarn-starting carriage runs on a predetermined path.

In FIG. 1 a spinning or twisting machine 10 which has a row of spinning and twisting stations on both of the long sides is shown schematically and broken away. The spinning or twisting stations indicated at 16 are named consecutive "workstations" and are symbolized by circles.

A yarn-starting carriage 11 for automatic removal of a yarn break can circulate around this machine 10. This yarn-starting carriage 11 has a counter or computer 22 which is automatically reset to "1" at a predetermined first workstation and/or the workstation A.

Then at each consecutive workstation at which the carriage 11 arrives during a complete circuit the counter 22 is stepped by the value "1" by a photelectric reflex sensor 12 so that the counter contents tally the number of the concerned workstation at which it has just arrived.

A reflex foil 13 is positioned at each work station for the reflex sensor 12 located on the yarn-starting carriage 11. Every time a reflex foil 13 is examined by the reflex sensor 12 a signal of the reflex sensor 12 supplies an output impulse stepping the counter 22 up by "1".

If the workstation A has the number "1", then the workstation B has the number "2" since the counter 22 raises its contents or tally to "2" on arrival of the yarn-starting carriage 11 at the workstation B.

If the spinning or twisting machine has 10 and/or 1000 workstations, then the last workstation Z passed by the carriage 11 in a complete cycle has the number 1000.

When the counter 22 is in step, then correspondingly its contents has the value "1000" at this workstation Z. For the case when the counter 22, because of some rare occurrence or condition should be out of step by one step forward or backward because of the great number of workstations, markings 30 are positioned at workstations 16 spaced equally from each other, for example at intervals of 50 workstations. These markings 30 contain the number of the workstation.

For example the markings 30 can be bar codes which give the number of the workstation and which can be read by a sensor or reader 29 located on the yarn-starting carriage 11, e.g. a photoelectric sensor which if necessary has a decoding circuit associated with it. This sensor 29 gives the number of the related workstation 16 read by it to an electronic comparator 32 in which also the momentary contents of the counter 22 always reside when the sensor 29 reads the markings 30 and feeds them to the comparator 32.

The comparator 32 tests then the agreement of the number of the workstation read by the sensor 29 with that found in the counter 22. Should there be agreement, then the counter contents are correct and the counter 22 is not adjusted. Should the comparator 32 in contrast establish that the counter contents or tally and the number read from the sensor 29 do not agree, then the counter contents are adjusted by count setting means, advantageously an electronic adjusting or control device 36.

Alternatively the counter 22 can advantageously be automatically adjusted by an electronic computer or counter to the number of the workstation read by the sensor 29 so that thereby the counter 22 is again brought into step.

It is also possible to eliminate the comparator 32 when the sensor 29 always, when it reads the number contained in the markings 30, gives the command directly to the adjusting or control means 36 to adjust the counter 22 to this number as is indicated by the dot-dashed arrow 31 in FIG. 1. If the counter 22 is already correctly adjusted, then this command does not alter the correct setting. In contrast an incorrect setting is corrected.

Further, a yarn-break sensor 17, advantageously a photoelectric sensor, is located on the yarn-starting carriage 11, which senses whether yarn is present or not at a workstation 16 at the arrival of the yarn-starting carriage 11. In the latter case, if a yarn break is present, the yarn-starting carriage 11 is automatically stopped at this workstation 16 in a known way in a predetermined position or configuration and activates a yarn break eliminating device for removal of the yarn break which is not shown. This then removes the yarn break. Should however the first attempt to remove the yarn break not succeed, then at least one further yarn break attempt is undertaken.

If a predetermined number of yarn break removal attempts are fruitless, for example two and/or three attempts, then automatically a data supply signal is generated so that the workstation involved is reported dead and is then registered in the memory 20 as a dead workstation by its number or else other data or code.

Figure 2:
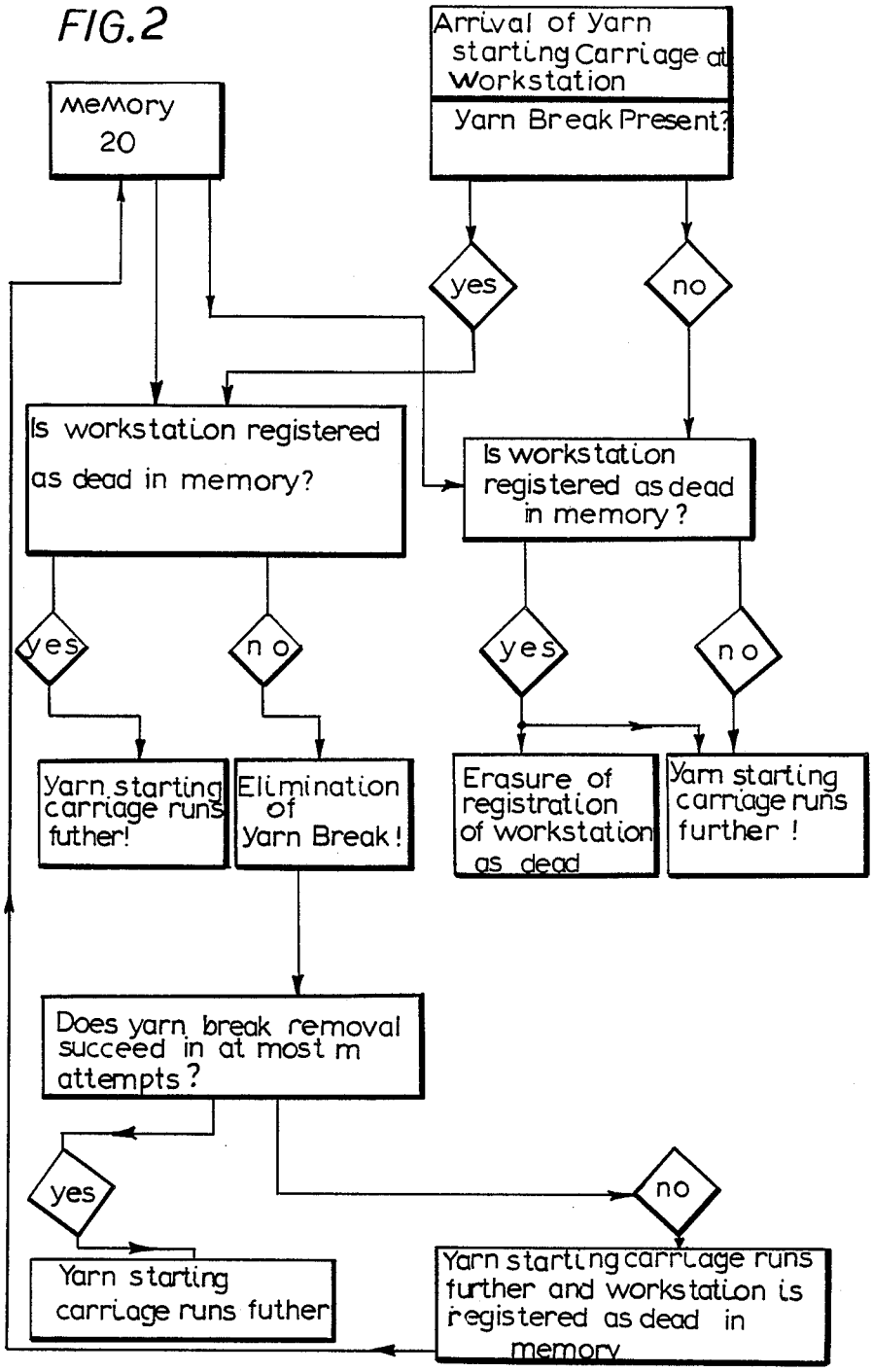
FIG. 2 is a flow chart for the registering and cancellation of registration of the dead workstations of the apparatus according to FIG. 1.

Should however the removal of the yarn break be successful, then automatically the rerunning of the yarn-starting carriage is commanded to test other workstations at which yarn breaks are to be eliminated as is shown in the flow chart according to FIG. 2.

On arrival at each individual workstation 16, whether a yarn is present or not at the workstation concerned is sensed by the yarn-break sensor 17. Simultaneously the data memory 20 is read to determine whether this workstation 16 as determined now by the counter 22 is or is not registered as dead. If no yarn is present at the workstation involved then a yarn break is present and when this workstation is registered as dead in the memory 20 then the yarn-starting carriage continues by, advantageously without stopping at it, especially appropriately with undiminished normal speed.

Likewise the yarn-starting carriage 11 runs by each workstation without stopping, also advantageously with unreduced normal carriage speed, when the yarn-break sensor 17 detects the presence of a yarn piece so that no yarn break is present at the workstation whether it is or is not registered as dead in the memory 20. When however, a workstation inspite of the presence of yarn is registered as dead in the memory its registration is automatically erased.

An operator tests the machine from time to time at the dead workstations at which also unremovable yarn breaks present have not been removed by the yarn-starting carriage 11, looks for the problems and removes them and then starts the yarn so that the concerned workstation now is in operation and also is no longer dead.

In the memory 20 the workstation is however still registered as dead. This registration is however, as described, automatically erased at the next arrival of the yarn-starting carriage 11 at the particular workstation 16, since the yarn-break sensor 17 senses whether a yarn break is present or not at such a workstation at the arrival of the yarn-break sensor 17.

When no yarn break is present the rerunning of the yarn-starting carriage is commanded and/or no command for stopping the yarn-starting carriage 11 is given so that it is not stopped at all.

Simultaneously with the determination that no yarn break is present however, the memory 20 is read to determine whether this workstation is registered as dead or not. When it is registered as dead then that is communicated to a signal generator 35 which causes the erasure of the registration of this workstation as dead in the memory 20.

Advantageously an addressable erasure signal can be sent to the memory 20 for erasure of the registration of this workstation as dead. This occurs also automatically and the operator need not be concerned by it and can also make no error in regard to it.

The yarn-break sensor 17 can for example be constructed so that it directly senses the presence or absence of yarn at the spinning station, e.g. it can be a reflex sensor. A mechanical yarn-break sensor can bear on the yarn which in case of a yarn break reaches a position which is sensed by the sensor 17 located on the yarn-starting carriage 11 without contact, e.g. by a reflex sensor. Also other structures are naturally possible.

Figure 3:
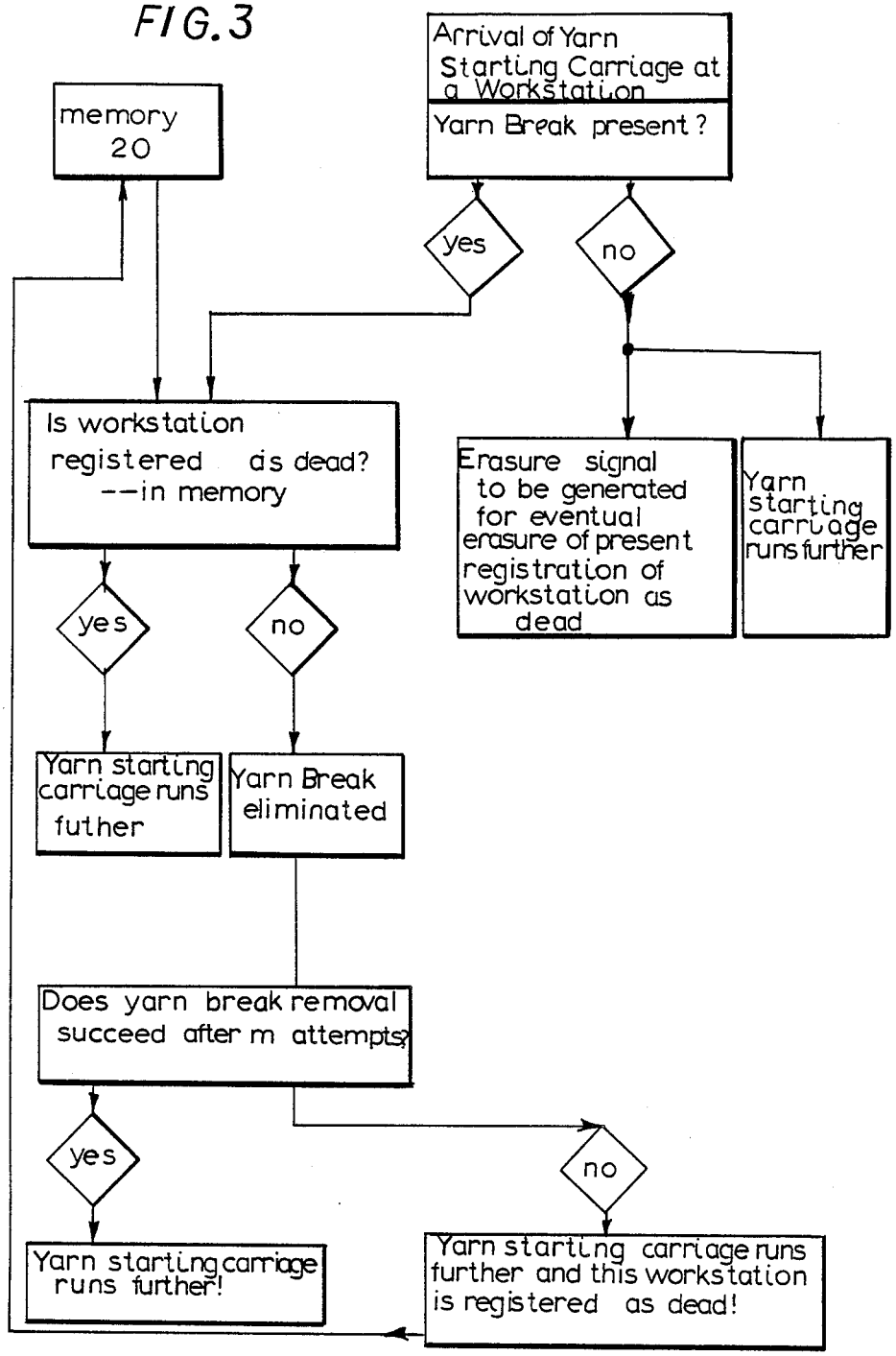
FIG. 3 is a variation of the flow chart according to FIG. 2 showing another example of the process according to my invention.

A flow chart according to a variation of the example of the flow chart according to FIG. 2 is illustrated in FIG. 3. The process illustrated in this flow chart runs at every arrival of the yarn-starting carriage 11 at a workstation 16. Also in the flow chart of FIG. 3 on every arrival of the yarn-starting carriage 11 whether a yarn break is present or not is sensed and tested at every arrival of the yarn-starting carriage at a workstation 16.

In case of "YES" the same process as in the flow chart of FIG. 2 runs unchanged. In contrast, in case no yarn break is present, similar to the process shown in the flow chart of FIG. 2, the further running of the yarn-starting carriage 11 without yarn break removal attempts is caused but the memory is no longer read to determine whether or not the workstation involved is registered as dead.

Instead continuously, when no yarn break is present at the workstation involved, an erasure signal is generated by the erasing means 35 which causes a registration of the workstation as dead to be eventually erased. If the workstation concerned is also registered as dead, this registration is erased when no yarn break is present. If in contrast it is not registered as dead, of course on failure to detect a yarn break also the erasure signal is released, however now no erasure can be caused in the memory for this workstation because this workstation is not registered as dead.

By "yarn break detection means" in the foregoing I mean the yarn-break sensor 17 and its associated electronic circuits.

I claim:

1. A process for registering dead workstations of a spinning or twisting machine having a plurality of workstations, particularly a ring spinning machine, in which yarn breaks can be automatically eliminated by a yarn-starting carriage, whereby at such workstations at which after a predetermined number of successive yarn break elimination attempts by said yarn-starting carriage fail, said workstations are automatically registered in a memory as one of said dead workstations and said yarn-starting carriage does not perform any yarn break operations at these dead workstations, said process comprising the steps of:

(a) automatically testing for yarn breaks each workstation regardless of a registration thereof as a dead workstation or not in said memory upon arrival at said workstation by said yarn-starting carriage;

(b) determining from said memory a registration as a dead workstation or not of said workstation being tested;

(c) automatically erasing from said memory as determined in step (b) the registration as a dead workstation of said workstation being tested if no yarn break is present thereat; and (d) displacing said yarn-starting carriage to a next workstation if said workstation being tested has no yarn break or upon completion of step (c).

2. A process for registering dead workstations of a spinning or twisting machine having a plurality of workstations, particularly a ring spinning machine, in which yarn breaks can be automatically eliminated by a yarn-starting carriage, whereby at such workstations at which after a predetermined number of successive yarn break elimination attempts by said yarn-starting carriage fail, said workstations are automatically registered in a memory as one of said dead workstations and said yarn-starting carriage does not perform any yarn break operations at these dead workstations, said process comprising the steps of:

(a) automatically testing for yarn breaks each workstation regardless of a registration thereof as a dead workstation or not in said memory upon arrival at said workstation by said yarn-starting carriage;

(b) automatically erasing from said memory a registration as a dead workstation of said workstation being tested if no yarn break is present thereat; and (c) displacing said yarn-starting carriage to a next workstation if said workstation being tested has no yarn break or upon completion of step (b).

3. The process defined in claim 2 wherein said yarn-starting carriage is only stopped at workstations at which a yarn break is to be eliminated and passes by other of said workstations without stopping.

4. The process defined in claim 2 wherein each of said workstations is associated with a different number or data for identification thereof.

5. The process defined in claim 4 wherein said workstations are numbered consecutively beginning with a predetermined first one of said workstations and a counter is provided which steps the number of said workstation to which said yarn-starting carriage reaches successively to provide a tally in said counter, said tally being initialized with respect to said predetermined first workstation, whereby said counter tally corresponds to the number of a workstation at which said yarn-starting carriage is instantaneously located.

6. The process defined in claim 5 wherein each of said dead workstations are registered in a predetermined memory location of said memory associated only with that one of said workstations.

7. The process defined in claim 5 wherein only said number or other data for said workstations which are dead are registered in said memory and on every arrival of said yarn-starting carriage at one of said workstations, said memory is read to determine whether said number or said other data for said workstation are stored in said memory.

8. The process defined in claim 5 wherein at predetermined workstations, respective markings are provided which indicate the number of a respective predetermined workstation and are read by a reader on said yarn-starting carriage.

9. The process defined in claim 8 wherein said predetermined workstations provided with said markings are equally spaced from one another and the number read at a respective marking by said reader is compared with the counter tally for that location, whereby when the number read disagrees with the counter tally, the counter tally is adjusted automatically to the number read by said reader.

10. The process defined in claim 8 wherein each time one of said markings indicating the number of a workstation is read, a command is executed which adjusts said counter to the number of said workstation identified, whereby if the counter tally varies from the number read by said reader, the counter tally is adjusted automatically to the number read by said reader.

11. The process defined in claim 2 wherein a workstation is registered as dead at which an m number of yarn breaks occur within a predetermined time interval, where m is a predetermined whole number greater than 1.

12. In an apparatus for registering dead workstations of a spinning or twisting machine having a plurality of workstations, particularly a ring spinning machine, of the type wherein a yarn-starting carriage is displaceable along said machine and said dead workstations are registered in a memory separately defined from said plurality of workstations, the improvement comprising:

yarn break detection means provided on said carriage for testing whether a yarn break is present or not upon arrival of said carriage at a workstation regardless of whether said workstation is registered as dead or not in said memory; and erasing means for automatically erasing from said memory a registration as dead of said workstation arrived at by said carriage and at which no yarn break is detected by said yarn break detection means.

13. The apparatus defined in claim 12, further comprising a counter for continuously tallying said workstations arrived at by said carriage starting at an initial workstation and consecutively stepping said counter in a complete circuit of said carriage around said machine and starting the tallying anew at the arrival of said carriage at said initial workstation.

14. The apparatus defined in claim 13 wherein markings are provided at selected workstations which have numbers corresponding to the tally of said counter upon correct counting when said carriage arrives at one of said selected workstations and said respective marking is read by a reader on said carriage, and adjusting means for adjusting the tally of said counter when the tally disagrees with the marking number.

15. The apparatus defined in claim 12 wherein at each arrival of said carriage at one of said workstations at which no yarn break is present, said memory is read and if said workstation is registered as dead, an erasing signal is activated for erasing the registration of said workstation as dead.

16. The apparatus defined in claim 12 wherein at each arrival of said carriage at one of said workstations at which no yarn break is present, an erasing signal is activated for erasing a registration of said workstation as dead.

* * * * *